US005234887A

United States Patent [19]

Gregory et al.

[11] Patent Number: 5,234,887

[45] Date of Patent: Aug. 10, 1993

[54] THERMAL TRANSFER PRINTING

[75] Inventors: Peter Gregory, Bolton; Raymond White, Radcliffe; Geoffrey Rothwell, Chadderton; Roy Porter, Delph, all of England

[73] Assignee: Imperial Chemical Industries PLC, London, United Kingdom

[21] Appl. No.: 791,903

[22] Filed: Jul. 10, 1991

Related U.S. Application Data

[63] Continuation of Ser. No. 10,798, Feb. 4, 1987, abandoned.

[30] Foreign Application Priority Data

Feb. 28, 1986 [GB] United Kingdom ..... 8604993
Oct. 15, 1986 [GB] United Kingdom ..... 8624696

[51] Int. Cl.[5] ..... B41M 5/035; B41M 5/38

[52] U.S. Cl. ..... 503/227; 428/195; 428/336; 428/913; 428/914

[58] Field of Search ..... 8/471; 428/195, 913, 428/914, 336; 503/227

[56] References Cited

U.S. PATENT DOCUMENTS

| | | | |
|---|---|---|---|
| 4,029,467 | 6/1977 | Defago et al. | 428/914 |
| 4,032,691 | 6/1977 | Kido et al. | 428/318.4 |
| 4,614,521 | 9/1986 | Niwa et al. | 8/471 |

FOREIGN PATENT DOCUMENTS

| | | | |
|---|---|---|---|
| 0001068 | 3/1979 | European Pat. Off. . | |
| 0066278 | 12/1982 | European Pat. Off. | 503/227 |
| 0216483 | 4/1987 | European Pat. Off. . | |
| 59-78896A | 5/1984 | Japan | 503/227 |
| 60-31565A | 2/1985 | Japan | 503/227 |
| 2036809 | 7/1980 | United Kingdom . | |
| 2159971 | 12/1985 | United Kingdom . | |

OTHER PUBLICATIONS

Patent Abstracts of Japan, vol. 11, No. 316 (M-631)[2763], 15th Oct. 1987; & JP-A-62 99 195 (Mitsui Toatsu Chem., Inc.) Aug. 5, 1987.

Patent Abstracts of Japan, vol. 11, No. 125 (M-582) [2572], 18th Apr. 1987; & JP-A-61 268 494 (Dainippon Printing Co., Ltd.) 27 Nov. 1986.

Derwent Abstract No. J6 0031-565-A, Mitsubishi Chem. Ind. KK, Jul. 28, 1983.

Derwent Abstract No. J5 9078-896-A, Mitsubishi Chem. Ind. KK, Oct. 28, 1982.

*Primary Examiner*—B. Hamilton Hess

*Attorney, Agent, or Firm*—Cushman, Darby & Cushman

[57] ABSTRACT

A thermal transfer printing sheet comprising a substrate having a coating comprising a dye of the formula:

A—N=N—E wherein

A is a phenyl group substituted by at least one electron-withdrawing group selected from $NO_2$, CN, $CF_3$, halogen, $—SO_2—C_{1-4}$-alkyl, $—SO_2F$, $—SO_2CF_3$, $—SO_2NRR^1$, $—CONRR^1$, —COOR, —CO—CO—R, wherein R and $R^1$ are independently selected from H and $C_{1-4}$ alkyl, provided that where A carries only two halogen atoms these are not in the 2- and 6-positions in relation to the azo link;

and E is the radical of an aniline, a tetrahydroquinoline, a lilolidine or a julolidine coupling component, and a thermal transfer printing process for the coloration of a polymeric substrate using the thermal transfer printing sheet.

9 Claims, No Drawings

THERMAL TRANSFER PRINTING

This is a continuation of application Ser. No. 07/010,798, filed Feb. 4, 1987, now abandoned.

This specification describes an invention relating to thermal transfer printing and more particularly to a thermal transfer printing sheet carrying a dye or a mixture of dyes and to a thermal transfer printing process in which dye is transferred from the transfer sheet to a receiver sheet by the application of heat.

In the form of thermal transfer printing with which the present application is concerned, a heat-transferable dye is applied to a sheet-like substrate, in the form of an ink, usually containing a polymeric or resinous binder to bind the dye to the substrate, to form a transfer sheet. This is then placed in contact with the material to be printed, the receiver sheet, and selectively heated in accordance with a pattern information signal whereby dye from the selectively heated regions of the transfer sheet is transferred to the receiver sheet and forms a pattern thereon the shape and density of which is in accordance with the pattern and intensity of heat applied to the transfer sheet.

Important criteria in the selection of a dye for TTP are its thermal properties, brightness of shade, fastness properties, such as light and heat fastness, and facility for application to the substrate in the preparation of the transfer sheet. For suitable performance the dye should transfer evenly, in a predetermined relationship to the heat applied to the transfer sheet so that the depth of shade on the receiver sheet is smoothly related to the heat applied and a good density gradation can be achieved on the receiver sheet. Brightness of shade is important in order to obtain as wide a range of shades with the three primary dye shades of yellow, cyan and magenta.

As the dye must be sufficiently mobile to migrate from the transfer sheet to the receiver sheet at the temperatures employed, typically 150°–400° C., more especially 300°–400° C., it is generally free from ionic and water-solubilising groups, and is thus not readily soluble in aqueous or water-miscible media, such as water and alkanols. Many suitable dyes are also not readily soluble in the solvents which are commonly used in, and thus acceptable to, the printing industry, such as aromatic hydrocarbons, alkanols and alkyl- and cycloalkylketones. Although the dye can be applied as a dispersion in a suitable solvent, it has been found that brighter, glossier and smoother final prints can often be achieved on the receiver sheet if the dye is applied to the substrate from a solution. To apply sufficient dye to the transfer sheet, and thereby to achieve the potential for a deep shade on the receiver sheet, it is desirable that the dye should be readily soluble in the ink medium, particularly if it has a relatively low extinction coefficient. It is also important that a dye which has been applied to a transfer sheet from a solution should be resistant to crystallisation so that it remains as an amorphous layer on the transfer sheet for a considerable time.

According to the present invention there is provided a thermal transfer printing sheet comprising a substrate having a coating comprising a dye of the formula:

$$A—N=N—E \qquad \text{I}$$

wherein

A is a phenyl group substituted by at least one electron-withdrawing group selected from $NO_2$, CN, $CF_3$, halogen, $—SO_2—C_{1-4}$-alkyl, $—SO_2F$, $—SO_2CF_3$, $—SO_2NRR^1$, $—CONRR^1$, —COOR, —CO—CO—R, wherein R and $R^1$ are independently selected from H and $C_{1-4}$ alkyl, provided that where A carries only two halogen atoms these are not in the 2- and 6-positions in relation to the azo link;

and E is the radical of an aniline, a tetrahydroquinoline, a lilolidine or a julolidine coupling component.

The phenyl group A, which is preferably free from groups carrying acidic hydrogen atoms capable of forming inter-molecular hydrogen bonds, such as OH, $NH_2$, $SO_3H$ and COOH, preferably carries from one to three, and more preferably at least two, of the defined electron-withdrawing groups and may also carry one or more other groups not having electron-withdrawing characteristics, such as $C_{1-4}$-alkyl and $C_{1-4}$-alkoxy. It is however, preferred, that A carries at least one, and more preferably two or three electron-withdrawing groups selected from $NO_2$, CN, $—SO_2—C_{1-4}$-alkyl, especially $—SO_2CH_3$ and halogen, especially bromo or chloro, and optionally also $C_{1-4}$-alkyl, especially $CH_3$, or $C_{1-4}$-alkoxy, especially $—OCH_3$. It is further preferred that A carries two or three groups selected from $NO_2$, CN and $—SO_2CH_3$. The substituents are preferably in the ortho and/or para positions with respect to the azo link.

A preferred substituted phenyl group, A, in the dyes of Formula I, giving orange to violet shades, is of the formula:

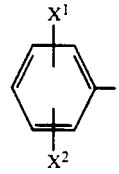

II wherein $X^1$ is $NO_2$, CN or $—SO_2CH_3$; and $X^2$ is $NO_2$, CN, $—SO_2CH_3$ or H.

and an especially preferred substituted phenyl group is of the formula:

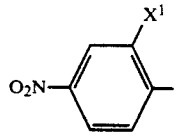

III wherein $X^1$ is $NO_2$, CN or $—SO_2CH_3$, gives strong magenta dyes of Formula I.

A preferred substituted phenyl group A in dyes of Formula I, giving blue shades, is of the formula:

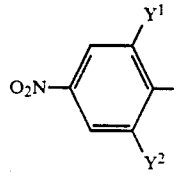

IV wherein $Y_1$ and $Y_2$ are independently selected from CN, $NO_2$ and halogen, especially Cl or Br, provided that they are not both $NO_2$ or both halogen.

In a dye of Formula IV, it is especially preferred that $Y^1$ and $Y^2$ are both CN or that $Y^1$ is CN and $Y^2$ is $NO_2$.

Specific examples of the substituted phenyl group, A, are:

| | |
|---|---|
| 2,4-dinitrophenyl, | 2-cyano-4-nitrophenyl, |
| 2,4-dicyanophenyl, | 2-nitro-4-cyanophenyl, |
| 3,4-dicyanophenyl | 2,5-chloro-4-nitrophenyl |
| 2,4-dinitro-6-chlorophenyl, | 2,4-dinitro-6-bromophenyl, |
| 2,4-dinitro-6-cyanophenyl, | 2,6-dicyano-4-nitrophenyl, |
| 2-chloro-4-nitrophenyl | 2-methylsulphonyl-4-nitrophenyl |
| 2-methoxy-4-nitrophenyl | 2,6-dicyano-4-methylphenyl |
| 2,5-dichlorophenyl | 2-methoxy-5-nitrophenyl |
| 4-nitrophenyl | |

The radical, E, of the coupling component is preferably derived from one of the following coupling components:

(i) an aniline of the formula:

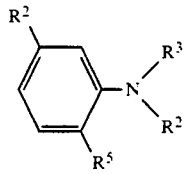

V wherein $R^2$ is selected from H, $C_{1-4}$-alkyl, $C_{1-4}$-alkoxy, $C_{1-4}$-alkylthio, $NH_2$—CO—NH—, HCONH—, phenyl—CONH—, $C_{1-4}$-alkyl—CO—NH—, $C_{1-4}$-alkyl—$SO_2$—NH—, CN, $CF_3$, and halogen;

$R^3$ and $R^4$ are independently selected from H; $C_{1-6}$-alkyl and $C_{4-8}$-cycloalkyl, each of which is unsubstituted or substituted by a group selected from halogen, CN, phenyl, mono- or bicyclic heteroaryl, —OCO—$C_{1-4}$-alkyl, —COO—$C_{1-4}$-alkyl, $C_{2-4}$-alkenyl, and $C_{1-4}$-alkoxy; or $R^3$ and $R^4$ together with the nitrogen atom to which they are attached form a heterocyclic ring, such as morpholine, piperazine or thiomorpholine;

and $R^5$ is selected from H, $C_{1-4}$-alkyl and $C_{1-4}$-alkoxy.

The radical E is formed by loss of the H atom para to the amino group.

(ii) a tetrahydroquinoline of the formula

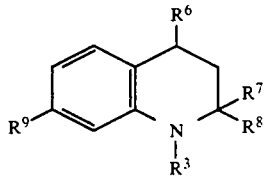

VI wherein $R^6$ to $R^9$ are selected from H and $C_{1-4}$-alkyl;

and $R^3$ is as hereinbefore defined.

The radical E is formed by loss of the H atom in the 7-position on the tetrahydroquinoline nucleus; or (iii) lilolidine or julolidine of the formula:

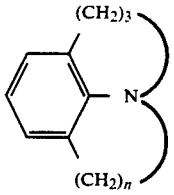

VII wherein n=2 (lilolidine) or n=3 (julolidine). The radical E is formed by loss the H-atom on the benzene ring situated in the para position to the N atom.

Examples of suitable coupling components in accordance with Formulae V, VI and VII are:

| | |
|---|---|
| lilolidine | julolidine |
| N-benzylaniline | N-ethyl-N-(2-acetoxyethyl)aniline |
| N,N-diethylaniline | N-ethyl-N-(2-phthalimidoethyl)aniline |
| N,N-bis(2-acetoxyethyl) aniline | N,N-bis(2-ethoxycarbonylethyl)aniline |
| N-ethyl-N-(2-cyanoethyl) aniline | N-ethyl-N-(n-butyl)aniline |
| N,N-di(n-propyl)aniline | N-ethyl-N-(2-ethoxyethyl)aniline |
| N,N-bis(2-methoxycarbonylethyl)aniline | |
| N-ethyl-N-(2-ethoxycarbonylethyl)aniline | |
| N,N-bis(2-methoxycarbonyloxyethyl)aniline | |
| N-(2-cyanoethyl)-N-(2-acetoxyethyl)aniline | |
| N-ethyl-N-(2-[phenoxyacetoxy]ethyl)aniline | |
| N-(2-cyanoethyl)-N-(2-[phenoxyacetoxy]ethyl)aniline | |
| N-(2-cyanoethyl)-N-(2-[i-propoxycarbonyloxy]ethyl)aniline | |
| N-(2-cyanoethyl)-N-(2-methoxy-3-phenoxy-n-propyl)aniline | |
| N-(2-cyanoethyl)-N-(2-[n-butylinocarbonyloxy]ethyl)aniline | |
| 1-(2-acetoxyethyl)-2,2,4,7-tetramethyl-i,2,3,4-tetrahydroquinoline and the 3-methyl, 3-acetylamino, 3-chloro and 3-methylsulphonylamino analogues thereof. | |

Preferred dyes of Formula I, giving orange to violet shades, are of the formula:

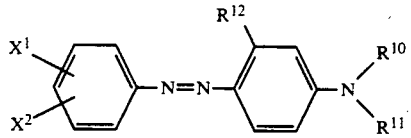

IX wherein $X^1$ is $NO_2$ or CN, $X^2$ is selected from $NO_2$, Cn, —$SO_2CH_3$ and H;

$R^{10}$ and $R^{11}$ are each independently selected from $C_{1-4}$-alkyl, —$C_2H_4CN$, $C_{1-4}$-alkylene—OCO—$C_{1-4}$-alkyl and $C_{1-4}$-alkylene—COO—$C_{1-4}$-alkyl and $R^{12}$ is H, $CH_3$ or —$NHCOCH_3$;

or out of the formula:

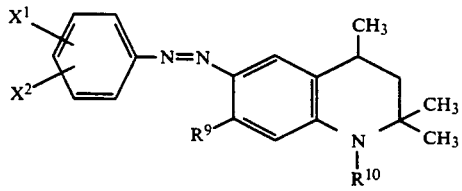

X wherein $X^1$, $X^2$, $R^9$ and $R^{10}$ are as hereinbefore defined.

In the dyes of Formula IX and X, is preferred that $X^2$ is $NO_2$, CN or —$SO_2CH_3$. An especially preferred class of dyes in accordance with Formula IX, giving a magenta shade, has the formula:

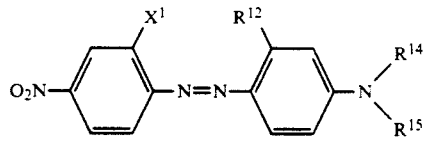

XI wherein $X^1$ and $R^{12}$ are as hereinbefore defined; and $R^{14}$ and $R^{15}$ are each independently selected from $C_{2-4}$-alkyl, $C_{1-4}$-alkylene—OCO—$C_{1-4}$-alkyl and $C_2H_4CN$.

Within this class of dyes it is especially preferred that $X^1$ is CN, $R^{12}$ is methyl, $R^{14}$ is ethyl, n-propyl, n-butyl or $—C_2H_4OCOCH_3$, and $R^{15}$ is $—C_2H_4OCOCH_3$.

Preferred dyes of Formula I, giving a blue shade, are of the formula:

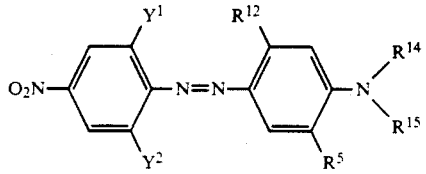

XII wherein $Y^1$ represents $NO_2$ or CN, $Y^2$ represents CN, Cl or Br and $R^{14}$ and $R^{15}$ are each independently selected from $C_{2-4}$-alkyl and $C_{1-4}$-alkylene—OCO—$C_{1-4}$-alkyl;

$R^5$ is H, $C_{1-4}$-alkyl or $C_{1-4}$-alkoxy; and $R^{12}$ is H, $CH_3$ or $—NHCOCH_3$.

In the dye of Formula XII it is especially preferred that $Y^1$ and $Y^2$ are both CN or that $Y^1$ is CN and $Y^2$ is $NO_2$ and that $R^5$ is H, $R^{12}$ is $—NHCOCH_3$ and $R^{14}$ and $R^{15}$ are $C_{2-4}$-alkyl.

Thermal transfer printing sheets carrying a compound of Formula I in which the coupling component is a substituted aniline of Formula V, wherein one or both of $R^3$ and $R^4$ is an alkyl group, especially ethyl or propyl, carrying an electron withdrawing group, especially CN, OCO—C -alkyl or COO—$C_{1-4}$-alkyl, are especially preferred species of the present invention because of their very good stability. Stability of a dye on the transfer sheet is an important property because dyes with poor stability (i) tend to crystallise on the sheet and as a result do not transfer evenly onto the receiver sheet during the TTP process and/or (ii) tend to transfer under pressure alone so that (a) the receiver sheet becomes coloured in areas to which no heat is applied, while it is in contact, under pressure, with the transfer sheet during the TTP process and (b) dye is transfered from the front to the back of the transfer sheet when the transfer sheet is rolled up.

A dye of Formula I generally has good thermal properties giving rise to even prints on the receiver sheet, whose depth of shade is related to the quantity of applied heat so that a good gradation of colour density can be obtained.

A dye of Formula I also generally has strong coloristic properties and good solubility in a wide range of solvents, especially those solvents which are widely used and accepted in the printing industry, such as alkanols, e.g. ethanol, isopropanol and butanol, aromatic hydrocarbons, such as toluene and ketones such as MEK, MIBK and cyclohexanone. This facilitates the application of the dye to the substrate from a solution and thus aids in the achievement of bright, glossy prints on the receiver sheet. The combination of strong coloristic properties and good solubility in the preferred solvents allows the achievement of deep and even shades of good light fastness.

The blue dye of Formula XII in which $Y^1$ and $Y^2$ are both CN, $R^5$ is H, $R^{12}$ is $—NHCOCH_3$ and $R^{14}$ and $R^{15}$ are both $C_2H_5$ allows the achievement of a strong bright greenish-blue print on the receiver sheet of moderate lightfastness and high optical density. The related dye in which $Y^2$ is $NO_2$ allows the achievement of a strong bright mid-blue shade print of good lightfastness and high optical density.

The dyes of Formula I give orange to blue shades. However, another important shade in trichromatic printing is black and mixtures of the present dyes, especially of dyes giving orange shades and dyes giving reddish blue shades, can be used to give good strong black shades.

Preferred orange dyes for use in such mixtures are of the formula:

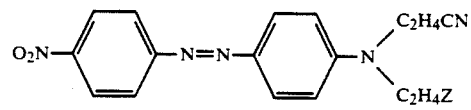

XIII wherein

Z is AH or $—OCOCH_3$.

Preferred blue dyes for use in such mixtures are of the formula:

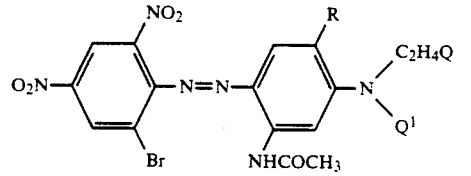

XIV wherein

R is H or $—OCH_3$;

Q is selected from H, $—OCOCH_3$ and $—COOC_2H_4OCH_3$; and $Q^1$ is selected from H, $—C_2H_5$ and $—C_2H_4OCOCH_3$.

Especially preferred blue dyes are those in which:

| | | | |
|---|---|---|---|
| Dye 1 | R = $—OCH_3$; | Q = H; | $Q_1$ = $—C_2H_5$ |
| Dye 2 | R = H; | Q = H; | $Q^1$ = $—C_2H_5$ |
| Dye 3 | R = $—OCH_3$; | Q = $—OCOCH_3$; | $Q^1$ = $—C_2H_4OCOCH_3$ |
| Dye 4 | R = $—OCH_3$; | Q = $—COOC_2H_4OCH_3$ | $Q^1$ = H |
| Dye 5 | 3:1 mixture of Dye 2 and Dye 1. | | |

The relatively proportions of the blue dye of Formula XII or XIV and the orange dye of Formula XIII required to produce a mixture giving a black shade depend on the shade of black required and the relative strengths of the component dyes. However the relative proportions generally range from 90:10 to 10:90 and more preferably from 70:30 to 30:70.

The coloristic properties and particularly the tinctorial strength of a dye of Formula I may be further improved by the addition of an azo dye containing a heterocyclic component. A suitable dye for use in admixture with one or more dyes of Formula I is one of the formula:

$$A^1—N=N—E \qquad XV$$

wherein:

$A^1$ is the radical of a diazotisable heteroaromatic amine, $A^1—NH_2$, in which A is selected from imidazolyl, pyrazolyl, thiazolyl, benzothiazolyl, isothiazolyl, benzoisothiazolyl, pyridoisothiazolyl & thiophenyl; and E is as hereinbefore defined.

The use of the dyes of Formula XV on TTP transfer sheets is described in European Patent Application No 86306158.6.

The radical, $A^1$, of the heteroaromatic amine, $A^1—NH_2$, may be substituted by non-ionic groups, preferably those which are free from acidic hydrogen atoms, unless these are positioned so that they form intramolecular hydrogen bonds. Examples of such substituents are $NO_2$; CN; CNS; halogen, especially F, Cl and Br; $CF_3$; $C_{1-4}$-alkyl; $C_{1-4}$-alkoxy; $C_{1-4}$-alkoxy-$C_{1-4}$-alkyl; cyano-$C_{1-4}$-alkyl; $—SO_2NH_2$; $—SO_2F$; $—SO_2Cl$; $—CONH_2$; —COF; —COCl; $C_{1-4}$-alkylthio; $—SO_2—C_{1-4}$-alkyl; $—CON—(C_{1-4}\text{-alkyl})_2$; $—SO_2N(C_{1-4}\text{-alkyl})_2$; $—COO—C_{1-4}$-alkyl and $—CO—C_{1-4}$-alkyl.

Examples of suitable heteroaromatic residues, A, are:

| | |
|---|---|
| 2,3-dicyanoimidazol-5-yl. | 1-ethyl-2,3-dicyanoimidazol-5-yl |
| 5-nitrothiazol-2-yl. | 3-methyl-4-cyanoisothiazol-5-yl. |
| 4-cyanoisothiazol-5-yl, | 6-fluorosulphonylbenzothiazol-2-yl. |
| 6-thiocyanobenzothiazol-2-yl. | 6-methylsulphonylbenzothiazol-2-yl. |
| 6-methoxybenzothiazol-2-yl. | 5-nitro-2,1-benzoisothiazol-3-yl. |
| 6-nitrobenzothiazol-2-yl. | 1-ethyl-3,4-dicyanopyrazol-5-yl. |
| 3,5-dicyanothiophen-1-yl. | 3-cyanomethyl-4-cyanopyrazol-5-yl. |
| 3,5-dinitrothiophen-1-yl. | 6-cyanopyrido[2,3-c]isothiazol-1-yl |
| 3-cyano-5-nitrothiophen-1-yl. | 6-nitropyrido[2,3-c]isothiazol-1-yl. |
| 3-formyl-5-nitrothiophen-1-yl, | 3-carboxy-5-nitrothiophen-1-yl, |
| 1-cyanomethyl-3,4-dicyanopyrazol-5-yl. | |
| 1-cyanomethyl-2,3-dicyanoimidazol-5-yl. | |
| 1,3-di(cyanomethyl)-4-cyanopyrazol-5-yl. | |
| 5-nitro-7-bromo-2,1-benzoisothiazol-3-yl. | |
| 5-methyl-6-cyanopyrido[2,3-c]isothiazol-1-yl. | |
| 5-methoxy-6-cyanopyrido[2,3-c]isothiazol-1-yl. | |

The radical E present in the dye of Formula XV is preferably derived from a coupling component of Formula V.

Preferred dyes of Formula XV are the magenta dyes where $A^1$ is 3-methyl-4-cyanoisothiazol-5-yl, 4-cyanoisothiazol-5-yl and 1-cyanomethyl-3,4-dicyanopyrazol-5-yl, and where E is the radical of an aniline of Formula V where $R^2$ is H, Cl or Cl-4-alkyl, especially $CH_3$; $R^5$ is H; and $R^3$ and $R^4$ are each independently selected from $C_2$-$C_4$-alkyl, optionally substituted by $—OCO—C_{1-4}$-alkyl, and especially from $C_2H_5$, n-$C_4H_9$, and $C_2H_4OCOCH_3$.

The preferred dyes of Formula XV are preferably used in admixture with the preferred dyes of Formula XI to prepare transfer sheets which have good storage stability and which give rise to magenta-shade prints of moderate lightfastness, of brighter shade than those derived from dyes of Formula XI and of significantly higher strength than is achievable with dyes of Formula XI alone.

The dyes of Formula XV are usually, but not necessarily, the minor components of the mixture.

The substrate may be any convenient sheet material capable of withstanding the temperatures involved in TTP, up to 400° C. over a period of up to 20 milliseconds (msec), yet thin enough to transmit heat applied on one side through to the dye on the other side to effect transfer to a receiver sheet within such short periods, typically from 1 to 10 msec. Examples of suitable materials are paper, especially high quality paper of even thickness, such as capacitor paper, polyester, polacrylate, polyamide, cellulosic and polyalkylene films, metallised forms thereof, including co-polymer and laminated films, especially laminates incorporating a polyester layer on which the dye is deposited. Such laminates preferably comprise, in addition to the polyester, a backcoat of a heat-resistant material, such as a thermosetting resin, e.g. silicone or polyurethane, to separate the heat source from the polyester so that the latter is not melted. The thickness of the substrate may vary within wide limits depending upon its thermal characteristics but is preferably less that 50 μm and more preferably below 10 μm.

The coating preferably comprises a binder and one or more dyes of Formula I, optionally with one or more dyes of Formula XV. The ratio of binder to dye is preferably at least 1:1 and more preferably from 1.5:1 to 4:1 in order to provide good adhesion between the dye and the substrate and inhibit migration of the dye during storage.

The binder may be any resinous or polymeric material suitable for binding the dye to the substrate. Examples of suitable binders are cellulose derivatives, such as ethylhydroxyethylcellulose (EHEC), hydroxypropylcellulose (HPC), ethylcellulose, methylcellulose, cellulose acetate and cellulose acetate butyrate; carbohydrate derivatives, such as starch; alginic acid derivatives; alkyd resins; vinyl resins and derivatives, such as polyvinyl alcohol, polyvinyl acetate, polyvinyl butyral and polyvinyl pyrrolidone; polymers and co-polymers derived from acrylates and acrylate derivatives, such as polyacrylic acid, polymethyl methacrylate and styrene-acrylate copolymers, polyester resins, polyamide resins, such as melamines; polyurea and polyurethane resins; organosilicones, such as polysiloxanes, epoxy resins and natural resins, such as gum tragacanth and gum arabic.

The coating may also contain other additives, such as curing agents, preservatives, etc., these and other ingredients being described more fully in EP 133011A, EP 133012A and EP 111004A.

According to a further feature of the present invention there is provided a transfer printing process which comprises contacting a transfer sheet coated with a dye of Formula I with a receiver sheet, so that the dye is adjacent to the receiver sheet, and selectively heating an area of the transfer sheet whereby dye in the heated area of the transfer sheet may be selectively transferred to the receiver sheet.

The transfer sheet is preferably heated to a temperature from 250° C. to 400° C., more preferably 300° C. to 400° C., for a period of from 0.5 to 30 msec, more preferably from 1 to 10 msec, while it is maintained in contact with the receiver sheet. The depth of shade of print on any area of the receiver sheet will vary with the time period for, and temperature at, which the transfer sheet is heated while in contact with the receiver sheet.

The receiver sheet conveniently comprises a white polyester sheet material, especially of polyethylene terephthalate (PET). Although the dye of Formula I is known for the colouration of textile materials made from PET, the colouration of textile materials, by dyeing or printing, is carried out under such conditions of time and temperature that the dye can penetrate the PET and become fixed therein. In thermal transfer printing, the time period is so short that penetration of the PET is less effective and the receiver sheet is preferably provided with a receptive layer on the side to which the dye is applied, into which the dye can more readily diffuse to form a stable image on the receiver sheet. Such a receptive coating may comprise a thin layer, applied to the receiver sheet by co-extrusion or solution coating techniques, of a modified polyester or a different polymeric material which is more permeable to the dye than PET. The nature of the receptive coating will affect to some extent the depth of shade and quality of the print obtained but it has been found that the present dyes give particularly strong and good quality prints compared with other dyes which have been previously proposed for thermal transfer printing on any specific receiver sheet. The design of receiver sheets with receptive layers is discussed in EP 133,011A and EP 133,012A.

The invention is further illustrated by the following examples in which all parts and percentages are by weight unless otherwise indicated.

Ink 1

A mixture of 0.1 g by weight of 3-methyl-4-(2-cyano-4-nitrophenylazo)-N,N-bis(2-acetoxyethyl)aniline 5 ml of chloroform and 9.5 ml of a solution of 2.7% ethylhydroxyethyl cellulose (EHEC - low mol wt grade) in chloroform was shaken until a homogeneous solution was formed. The absorption maximum and the molar extinction coefficient was determined and is recorded in Table 1.

Inks 2 to 26

A further 25 inks were prepared by the same method as Ink 1 using each of the azo dyes or mixtures of azo dyes indicated in Table 1 below.

EXAMPLE 1

A thermal transfer sheet was prepared by forming a 24 μm coating of Ink 1 (using a Mayer bar) on the precleaned (with dichloromethane) surface of a sheet of PET film (6 μm, MELINEX) having a thermally protected back-coat layer (2 μm). The coating was dried in hot air stream. The transfer sheet is hereinafter referred to as TSl.

EXAMPLES 2 TO 26

A further 25 transfer sheets (TS2 to TS26) were prepared by the method of Example 1 using Inks 2 to 26 in place of Ink 1.

EXAMPLE 27

Transfer sheet TSl was sandwiched with a composite receiver sheet comprising a while PET substrate and a receptive layer on the side in contact with the printed surface of TSl. The sandwich was placed on the cylindrical drum of thermal transfer-printing machine. On rotation of the drum, the sandwich passed over a matrix of closely spaced pixels which were selectively heated in accordance with a pattern information signal to a temperature of 350° C. for periods from 1 to 10 msec, whereby a quantity of the dye, in proportion to the heating period, at the position on the transfer sheet in contact with a pixel while it was hot, was transferred from the transfer sheet to the receiver sheet. The pattern information signal was formulated so that the heating period of the pixels was increased at regular intervals as the sandwiched passed over the matrix so that the printed pattern was in the form of a scale composed of bands of colour of increasing depth of shade. After passage over the array of pixels the transfer sheet was separated from the receiver sheet. Superficial dye which had not penetrated the receptor layer on the receiver sheet was removed by the application and removal of a strip of self-adhesive tape. The printed receiver sheet is hereinafter referred to as RSl.

EXAMPLES 28 TO 52

A further 25 receiver sheets (RS 2 to RS 26) were printed by the method of Example 27 using TS2 to TS 26 in place of TSl.

Assessment of Receiver Sheets

The reflectance optical density of the print on each receiver sheet was measured by examination of the band having the maximum depth of shade with a Sakura digital densitometer and the results of the measurements are given in Table 1. Magenta dyes were examined through a green filter and blue dyes were examined through a red filter.

TABLE 1

| Ink/Ex | Dye | Abs Max (EtOAc) | Molar Extinct Coeff | Reflectance Optical Density |
|---|---|---|---|---|
| 1/27 | 3-methyl-4-(2-cyano-4-nitrophenylazo)-N,N-bis-(2-acetoxyethyl)-aniline | 516 | 37,647 | 1.08 |
| 2/28 | 4-(2-cyano-4-nitrophenylazo)-N,N-bis-(2-acetoxyethyl)aniline | 503 | 34,188 | 1.40 |
| 3/29 | 4-(2-cyano-4-nitrophenylazo)-N,N-diethylaniline | 529 | 43,397 | 1.68 |
| 4/30 | 4-(2-cyano-4-nitrophenylazo)-N-(2-acetoxyethyl)-N-ethylaniline | 518 | 37,361 | 1.20 |
| 5/31 | 4-(2-cyano-4-nitrophenylazo)-N-(2-ethoxyethyl)-N-ethylaniline | 526 | 39,170 | 1.52 |
| 6/32 | 4-(2-cyano-4-nitrophenylazo)-3-acetylamino-N,N-bis-(2-methoxycarbonyl-ethyl)aniline | 534 | 48,405 | 1.40 |
| 7/33 | 4-(2,4-dicyanophenylazo)-3-acetylamino-N,N-diethylaniline | 525 | 55,800 | 1.77 |
| 8/34 | 4-(2,4-dinitrophenylazo)-3-acetylamino-N,N-bis-(2-methoxycarbonylethyl)-aniline | 530 | 48,784 | 1.19 |
| 9/35 | 6-(3,4-dicyanophenylazo)-1-(2-acetoxyethyl)-1,2,3,4-tetrahydro-2,2,4,7-tetramethyl-quinoline | 501 | 39,128 | 1.00 |
| 10/36 | 3-methyl-4-(2,4-dinitrophenylazo)-N,N-bis-(2-ethoxy-carbonylethyl)-aniline | 514 | 35,427 | 1.10 |
| 11/37 | 3-methyl-4-(2,4-dinitrophenylazo)-N-(2-acetoxyethyl)-N-ethyl-aniline | 523 | 36,225 | 1.20 |
| 12/38 | 3-methyl-4-(2,4-dinitrophenylazo)-N,N-bis-(2-acetoxyethyl)aniline | 507 | 35,232 | 1.10 |
| 13/39 | 3-methyl-4-(2-cyano-4-nitrophenylazo)-N,N-diethylaniline | 541 | 42,542 | 1.60 |
| 14/40 | 3-methyl-4-(2-cyano-4-nitrophenylazo)-N-ethyl N-(2-acetoyethyl)aniline | 529 | 41,223 | 1.50 |
| 15/41 | 3-methyl-4-(2-cyano-4-nitrophenylazo)- | — | — | 1.80 |

TABLE 1-continued

| Ink/Ex | Dye | Abs Max (EtOAc) | Molar Extinct Coeff | Reflectance Optical Density |
|---|---|---|---|---|
| | N,N-bis-(2-acetoxyethyl)aniline + 3-methyl-4-(3-methyl-4-cyano-isothiazol-5-yl)-N,N-diethylaniline | | | |
| 16/42 | 3-methyl-4-(2-cyano-4-nitrophenylazo)-N,N-bis-(2-acetoxyethylaniline + 4-(3-methyl-4-cyano-isothiazol-5-yl)-N,N-diethylaniline | — | — | 2.10 |
| 17/43 | 4-(2-cyano-4-nitrophenylazo)-N-(2-cyanoethyl)-N-ethylaniline | 500 | 36,743 | 1.20 |
| 18/44 | 3-acetylamino-4-(2,5-dichloro-4-nitrophenylazo)-N,N-diethylaniline | 525 | 49,068 | 1.57 |
| 19/45 | 3-methylsulphonylamino-4-(2-chloro-4-nitrophenylazo)-N,N-bis-(methoxycarbonylethyl)aniline | — | — | 0.92 |
| 20/46 | 3-methylsulphonylamino-4-(2-bromo-4,6-dinitrophenylazo)-N,N-bis-(methoxycarbonylethyl) aniline | — | — | 1.00 |
| 21/47 | 3-acetylamino-4-(2-methoxy-5-nitrophenylazo)-N,N-bis-(methoxycarbonylethyl)-aniline | 466 | 36,971 | 0:75 |
| 22/48 | 4-(4-nitrophenylazo)-N-(2-cyanoethyl)-N-(2-acetoxyethyl)aniline | 445 | 32,095 | 1.23 |
| 23/49 | 4-(4-nitrophenylazo)-N-(2-cyanoethyl)-N-ethylaniline | — | — | 1.40 |
| 24/50 | 3-acetylamino-4-(2,4-dinitro-6-bromophenylazo)-N,N-diethylaniline | 556 | 51,497 | 1.28 |
| 25/51 | 3-acetylamino-4-(2,6-dicyano-4-nitrophenylazo)-N,N-diethylaniline | 606 | 77,000 | 1.81 |
| 26/52 | 3-acetylamino-4-(2,4-dinitro-6-cyanophenylazo)-N,N-diethylaniline | 605 | 67,366 | 1.58 |

EXAMPLE 53

Three black dye mixtures were prepared from the following dyes:

Dye A: 3-acetylamino-4-(2,4-dinitro-6-bromophenylazo)-N,N-diethylaniline

Dye B: 5-acetylamino-4-(2,4-dinitro-6-bromophenylazo)-2-methoxyN,N-diethylaniline Dye C: 4-(4-nitrophenylazo)-N-(2-cyanoethyl)-N-(2-acetoxyethyl)aniline Dye D: 1-ethyl-3-cyano-4-methyl-5-(4-[2-(2-methoxyethoxy)ethoxycarbonylphenylazo)-pyrid-2,6-dione Dye E: 1-ethyl-3-cyano-4-methyl-5-(2-nitrophenylazo)-pyrid-2,6-dione Black 1 0.43g Dye A +0.16g Dye B +0.42g Dye C Black 2 0.43g Dye A +0.16g Dye B +0.31g Dye C +0.1g Dye D Black 3 0.43g Dye A +0.16g Dye B +0.31g Dye C +0.11g Dye E Each of these mixtures was formed into an ink by the method for Ink 1 and the ink used to prepare a transfer sheet by the method of Example 1. Each black mixture was transfered by the method of Example 27 to produce a receiver sheet having an even black shade.

Other dyes which are suitable for the preparation of thermal transfer sheets by the methods hereinbefore described are:

4-(2-cyano-4-nitrophenylazo)-N-(2-cyanoethyl)-N-(2-acetoxyethyl)-aniline 4-(2-cyano-4-nitrophenylazo)-N-(2-cyanoethyl)-N-(2-methoxycarbonylethyl)aniline 4-(2-cyano-4-nitrophenylazo)-N-(2-cyanoethyl)-N-(2-methoxycarbonyloxyethyl)aniline 4-(2-cyano-4-nitrophenylazo)-N-(2-cyanoethyl)-N-(2-[phenoxymethylcarbonyloxy]ethyl)aniline 4-(2-cyano-4-nitrophenylazo)-N-(2-cyanoethyl)-N-(2-[i-propoxycarbonyloxy]ethyl)aniline 4-(2-cyano-4-nitrophenylazo)-N-(2-cyanoethyl)-N-(2-methoxy-3-phenoxyn-propyl)aniline 4-(2-cyano-4-nitrophenylazo)-N-(2-cyanoethyl)-N-(2-[n-butylaminocarbonyloxy]ethyl)aniline 4-(2-cyano-4-nitrophenylazo)-N,N-bis(2-methoxycarbonyloxyethyl)aniline 4-(2-methylsuphonyl-4-nitrophenylazo)-N-ethyl-N-(2-acetoxyethyl)aniline 4-(2-methylsuphonyl-4-nitrophenylazo)-N-ethyl-N-(2-[phenoxymethylcarbonyloxy]ethyl)aniline 3-methyl-4-(2-cyano-4-nitrophenylazo)-N,N-bis(2-methoxycarbonyloxyethyl)aniline 3-methyl-4-(2-chloro-4-nitrophenylazo)-N-ethyl-N-(2-phthalimidoethyl)aniline 3-methyl-4-(2-methylsuphonyl-4-nitrophenylazo)-N,N-bis(2-acetoxyethyl)aniline 3-chloro-4-(2-cyano-4-nitrophenylazo)-N-ethyl-N-(2-ethoxycarbonylethyl)aniline 3-acetylamino-4-(2-cyano-4-nitrophenylazo)-N-ethyl-N-(2-phthalimidoethyl)aniline 3-acetylamino-4-(2-cyano-4-nitrophenylazo)-N-benzylaniline 3-acetylamino-4-(2-cyano-4-nitrophenylazo)-N,N-bis(2-methoxyethyl)-aniline 3-acetylamino-4-(2-methoxy-4-nitrophenylazo)-N,N-bis(2-acetoxyethyl)aniline 3-methylsulphonylamino-4-(2,6-dicyano-4-nitrophenylazo)-N,N-diethylaniiine 3-methylsulphonylamino-4-(2,6-dicyano-4-nitrophenylazo)-N,N-bis(n-propyl)aniline 3-acetylamino-4-(2,4-dinitro-6-bromophenylazo)-N,N-diethylaniline 5-acetylamino-4-(2,4-dinitro-6-bromophenylazo)-2-methoxy-N,N-diethylaniline 4-(4-nitrophenylazo)-N-(2-cyanoethyl)-N-ethylaniline 4-(4-nitrophenylazo)-N-(2-cyanoethyl)-N-(2-acetoxyethyl)aniline and compound shades such as brown, grey and black, by mixing these dyes in appropriate proportions.

COMPARATIVE EXAMPLE

An ink (Ink A) was made according to the procedure of Ink 1 using the same weight of 1-amino-2-phenoxy-4-hydroxyanthraquinone in place of Dye 1. A transfer sheet (TSA) was prepared according to Example 1 using Ink A in place of Ink 1. A printed receiver sheet (RSA) was prepared by the method of Example 27 using TSA in place of TSl. The reflectance optical density of RSA was measured by examination of the band having maximum depth of shade with a Sakura digital densitometer under the same conditions as the asessment of receiver sheets RSl to RS26. The result of the measurement is shown below in comparison with that of RSl (taken from Example 27 in Table 1)

| Receiver Sheet | Reflectance Optical Density |
|---|---|
| RSA | 0.63 |
| RS1 | 1.08 |

We claim:

1. A thermal transfer printing sheet comprising a substrate having a thickness less than 10 micrometers carrying a coating comprising a dye of the formula:

$$A-N=N-E$$

wherein

A is a phenyl group substituted by two or three electron withdrawing groups selected from $NO_2$, CN and $-SO_2-C_{1-4}$-alkyl and optionally by one or more groups selected from $C_{1-4}$-alkyl and $C_{1-4}$-alkoxy;

and E is selected from (i) an anilino group of the formula:

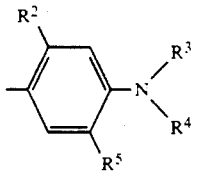

wherein $R^2$ is selected from H, $C_{1-4}$-alkyl, $C_{1-4}$-alkoxy, $C_{1-4}$-alkylthio, $NH_2-CO-NH$, NCONH—, phenyl-CONH—, $C_{1-4}$-alkyl—CO—NH, $C_{1-4}$-alkyl—$SO_2$—NH—, CN, $CF_3$, and halogen; $R^3$ and $R^4$ are independently selected from H; $C_{1-6}$-alkyl and $C_{4-8}$-cycloalkyl, each of which is unsubstituted or substituted by a group independently selected from halogen, CN, phenyl, mono- or bicyclic heteroaryl, —OCO—$C_{1-4}$-alkyl, —COO—$C_{1-4}$-alkyl, $C_{2-4}$-alkenyl, and $C_{1-4}$-alkoxy; or $R^3$ and $R^4$ together with the nitrogen atom to which they are attached form a heterocyclic ring, selected from morpholine, piperazine and thiomorpholine;

and $R^5$ is selected from H, $C_{1-4}$-alkyl and $C_{1-4}$-alkoxy;

(ii) a tetrahydroquinolinyl group of the formula:

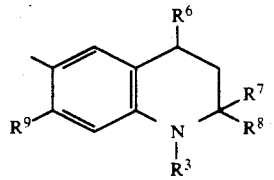

wherein $R^3$ is selected from H; $C_{1-6}$-alkyl, $C_{4-8}$-cycloalkyl, each of which is independently unsubstituted or substituted by a group selected from halogen, CN, phenyl, mono- or bicyclic heteroaryl, —OCO—$C_{1-4}$-alkyl, —COO—$C_{1-4}$-alkyl, $C_{2-4}$-alkenyl, $C_{1-4}$-alkoxy; and $R^6$ to $R^9$ are independently selected from H and $C_{1-6}$-alkyl;

and (iii) lilolidinyl or julolidinyl of the formula:

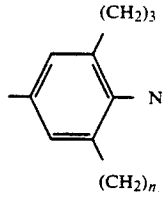

wherein n=2 (lilolidine) or 3 (julolidine).

2. A thermal transfer printing sheet according to claim 1 wherein A is of the formula:

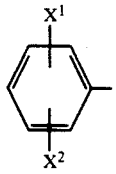

wherein $X^1$ is $NO_2$, CN or $-SO_2Ch_3$;

and $X^2$ is $NO_2$, CN or $-SO_2CH_3$.

3. A thermal transfer printing sheet according to claim 1 where A is of the formula

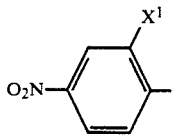

wherein

X' is $NO_2$, CN or $SO_2,CH_3$.

4. A thermal transfer printing sheet according to claim 1 wherein A is of the formula:

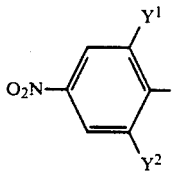

wherein $Y^1$ and $Y^2$ are independently selected from CN and $NO_2$, provided that they are not both $NO_2$.

5. A thermal transfer printing sheet comprising a substrate having a thickness less than 10 micrometres carrying a coating including a dye of the formula:

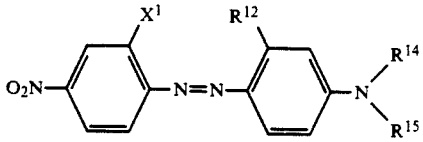

wherein $X^1$ is $NO_2$ or CN;

$R^{12}$ is selected from H, $CH_3$ and $-NHCOCH_3$; and $R^{14}$ and $R^{15}$ are each independently selected from $C_{2-4}$-alkyl, $C_{1-4}$-alkylene—OCO—$C_{1-4}$-alkyland $C_2H_4CN$.

6. A thermal transfer printing sheet comprising a substrate having a thickness less than 10 micrometres carrying a coating including a dye of the formula:

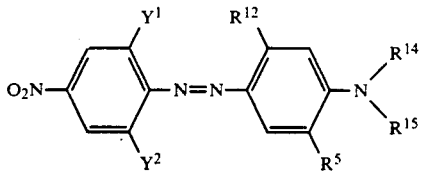

wherein $Y^1$ is $NO_2$ or CN;

$Y^2$ is CN;

$R^{14}$ and $R^{15}$ are each independently selected from $C_{2-4}$-alkyl and $C_{1-4}$-alkylene—OCO—$C_{1-4}$-alkyl;

$R^5$ is selected from H, $C_{1-4}$-alkyl and $C_{1-4}$-alkoxy; and $R^{12}$ is selected from H, $CH_3$ or —$NHCOCH_3$.

7. A thermal transfer printing sheet comprising a substrate having a thickness less than 10 micrometres carrying a coating including a dye of the formula:

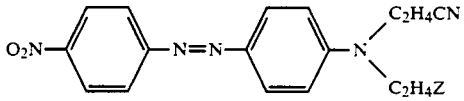

wherein

Z is H or —$OCOCH_3$;

in admixture with a dye of the formula:

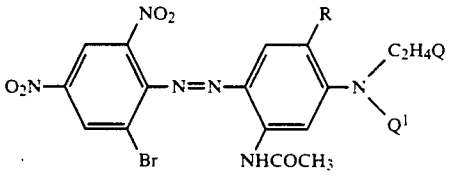

wherein

R is H or —$OCH_3$;

Q is selected from H, —$OCOCH_3$ and —$COOC_2H_4OCH_3$; and $Q^1$ is selected from H, —$Ch_2H_5$ and —$C_2H_4OCOCH_3$.

8. A thermal transfer printing sheet comprising a substrate having a thickness less than 10 micrometres carrying a coating including a dye of the formula:

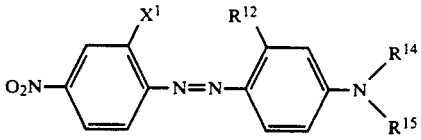

wherein $X^1$ is $NO_2$ or CN;

$R^{12}$ is selected from H, $CH_3$ and —$NHCOCH_3$; and $R^{14}$ and $R^{15}$ are each independently selected from $C_{2-4}$-alkyl, $C_{1-4}$-alkylene—OCO—$C_{1-4}$-alkyl and $C_2H_4CN$;

in admixture with a dye of the formula:

$$A^1—N=N—E$$

wherein $A^1$ is selected from 3-methyl-4-cyanoisothiazol-5-yl, 4-cyano-isothiazol-5-yal and 1-cyanomethyl-3,4-dicyanopyrazol-5-yl;

and E is of the formula:

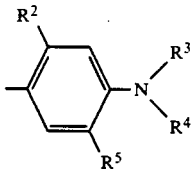

wherein $R^2$ is selected from H, chlorine and $C_{1-4}$-alkyl;

$R^3$ and $R^4$ are each independently $C_{2-4}$-alkylene-OCO—$C_{1-4}$-alkyl or $C_{2-4}$-alkyl; and $R^5$ is H.

9. A thermal transfer printing process which comprises contacting a thermal transfer printing sheet according to any one of claims 1–8 with a receiver sheet, so that the dye is adjacent to the receiver sheet, and selectively heating an area of the transfer sheet to a temperature from 250° C. to 400° C. for a period of from 0.5 to 30 msec whereby dye in the heated area of the transfer sheet may be selectively transferred to the receiver sheet.

* * * * *

UNITED STATES PATENT AND TRADEMARK OFFICE

CERTIFICATE OF CORRECTION

PATENT NO. : 5,234,887
DATED : August 10, 1993
INVENTOR(S) : Gregory, et. al.

It is certified that error appears in the above-indentified patent and that said Letters Patent is hereby corrected as shown below:

On the Title page, item [22], the patent should be November 15, 1988--.

ii) The structure at the top of column 14 should be:

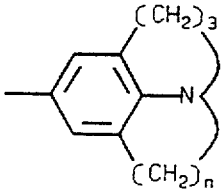

iii) Column 14, line 24 should read:
$X^1$ is $NO_2$, CN or $-SO_2CH_3$.

iv) Column 14, line 38 should read:
$X^1$ is $NO_2$, CN or $-SO_2CH_3$.

UNITED STATES PATENT AND TRADEMARK OFFICE

CERTIFICATE OF CORRECTION

PATENT NO. : 5,234,887

DATED : August 10, 1993

INVENTOR(S) : Gregory, et. al.

It is certified that error appears in the above-indentified patent and that said Letters Patent is hereby corrected as shown below:

v) Column 15, line 49 should read: $Q^1$ is selected from H, $-C_2H_5$ and $-C_2H_4OCOCH_3$.

Signed and Sealed this

Twenty-second Day of November, 1994

*Attest:*

*Attesting Officer*

Bruce Lehman

BRUCE LEHMAN

*Commissioner of Patents and Trademarks*